United States Patent [19]

Kasberger

[11] Patent Number: 4,807,374

[45] Date of Patent: Feb. 28, 1989

[54] EXCAVATOR, IN PARTICULAR SELF-DRIVING, HYDRAULIC UNIVERSAL SMALL EXCAVATOR

[75] Inventor: Peter Kasberger, Augsburg, Fed. Rep. of Germany

[73] Assignee: Fa. Lescha Maschinenfabrik GmbH, Augsburg, Fed. Rep. of Germany

[21] Appl. No.: 35,590

[22] Filed: Apr. 6, 1987

[30] Foreign Application Priority Data

Aug. 14, 1986 [DE] Fed. Rep. of Germany ..... 3627719

[51] Int. Cl.[4] ..... E02F 5/02

[52] U.S. Cl. ..... 37/103; 212/189; 280/491 A; 280/764.1

[58] Field of Search ..... 37/103, 117.5; 280/465 R, 475, 491, 638–639, 38–40, 43.15, 43.16, 43.17, 43.23, 822, 763.1, 764.1, 765.1, 766.1, 100–101, 125; 180/208–209, 8.3, 8.5, 8.9; 414/694, 718; 212/189

[56] References Cited

U.S. PATENT DOCUMENTS

| | | | |
|---|---|---|---|
| 2,436,799 | 3/1948 | Frost | 212/189 |
| 3,236,324 | 2/1966 | Levratto | 280/43.16 X |
| 3,279,622 | 10/1966 | Person | 212/189 |
| 3,589,538 | 6/1971 | Menzi | 37/103 |
| 3,777,919 | 12/1973 | Konijn | 37/73 X |
| 4,084,777 | 4/1978 | Lambert | 212/189 |
| 4,118,054 | 10/1978 | Vigerie | 212/189 |
| 4,241,803 | 12/1980 | Lauber | 212/189 |
| 4,395,191 | 7/1983 | Kaiser | 280/764.1 |
| 4,531,882 | 7/1985 | Pierre | 280/475 |
| 4,597,498 | 7/1986 | Spinosa et al. | 212/189 |

*Primary Examiner*—Eugene M. Eickholt
*Attorney, Agent, or Firm*—Edwin D. Schindler

[57] ABSTRACT

The excavator of the present invention has wheels which are suspended or respectively attached in a special way. When the excavator moves or is transported, the wheels are in their vertical normal position and for excavating purposes preferably all wheels are tilted sideways. This measure increases the seating surface of the excavator and therefore its stability on the ground. For this purpose, the wheels are tiltingly attached to axle extensions which can be moved in the direction of the axle. The said axle extensions are pulled in when the excavator moves, and for excavating tasks are pushed out towards the side whereby the tilting of the wheels takes place. Pistons inside the axle effect the moving of the axle extensions.

16 Claims, 4 Drawing Sheets

Figure 3:
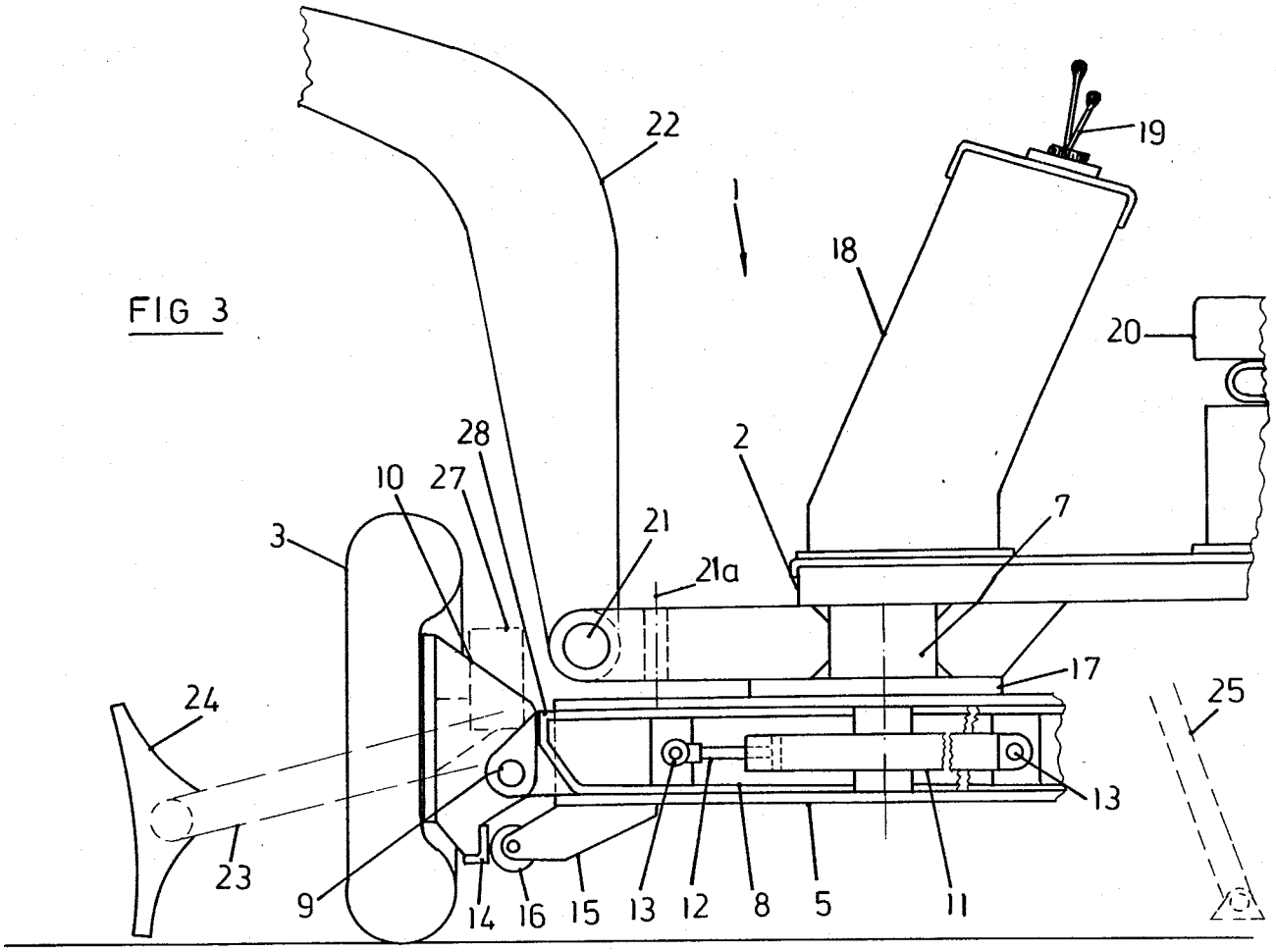

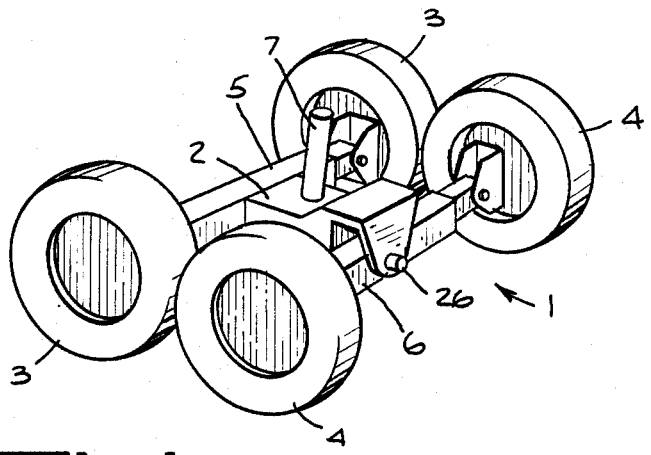
Fig. 1.
Fig. 2.
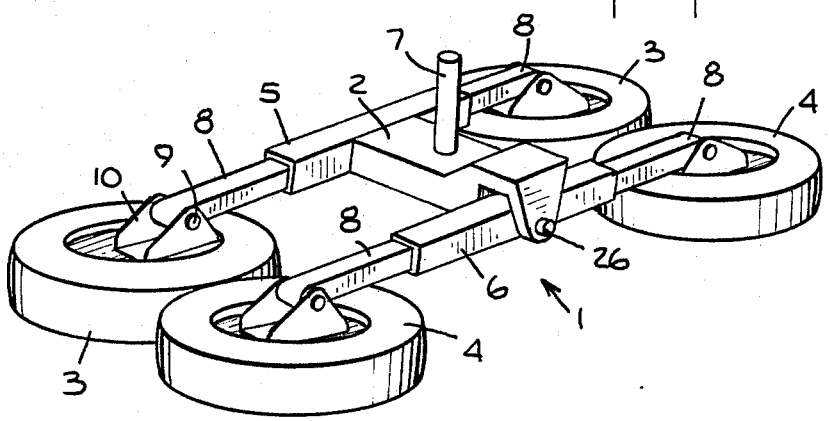

EXCAVATOR, IN PARTICULAR SELF-DRIVING, HYDRAULIC UNIVERSAL SMALL EXCAVATOR

BACKGROUND OF THE INVENTION

The present invention relates to an excavator, in particular a self-driving, hydraulic universal small excavator, for working soil, laying utility pipes, excavating ditches, foundation holes, etc., with an excavator arm attached to an undercarriage preferably by means of a turning mechanism, with control and driving devices, as well as with at least one pair of wheels fixed to either side of an axle.

Excavators of this kind are generally known and are used for the most varied tasks in numerous different environmental conditions. Even relatively small excavators, so-called universal small excavators, are expected to master important tearing and breaking forces, which causes no problems as far as the engine in concerned. However, particularly under certain ground conditions as for example hard surfaces such as concrete, asphalt, etc., it can prove difficult to secure the said excavators sufficiently so that the available forces can be fully used. Additional stabilizing devices such as retractable supports are only partly successful. On the other hand, the excavators are expected to be fully suitable for cross country operation, i. e. they should be able to work on less solid ground without sinking too deeply, i. e. the seating pressure of the excavator should be as little as possible It is self-evident that also the center of gravity of the excavator should be as far down as possible and that the same should above all hold true for the turning point of the excavator arm. On the other hand, maneuverability, speed and compactness with little need of space are also strongly asked for. The excavators known so far could only partly fulfill these requirements. One reason for that is that tall wheels are needed to adapt the excavator sufficiently for cross country conditions, i. e to enable it to go uneven ground with depressions and holes without touching down. On the other hand, while coping with the above demands, the center of gravity of the excavator and in particular the turning point of the excavator arm are automatically raised if a 360-degree-turn of a superstructure accommodating the excavator arm is asked for. In the other case, increasing the size of the wheels is paramount to reducing the maneuverability of the superstructure.

SUMMARY OF THE INVENTION

Taking these disadvantages which are encountered with more or less all previously known excavators into account, it is therefore one object of the present invention to improve excavators, in particular self-driving, hydraulic universal small excavators, so that, compared with the previously known excavators, there is more stability when excavating, and maintaining the 360-degree-turnability of the excavator arm or respectively the superstructure, the center of gravity of the excavator and the turning point of the excavator arm can be lowered thus achieving excellent working conditions on soft ground, i. e. high safety against sinking into the ground. Furthermore, in transport conditions, i. e. a normal driving conditions, of the excavator, the speed should not be inferior that of the previously known excavators and the excavator of the invention should be able to be easily maneuvered and to perform a point turn round its own axis.

In order to effect these objects, each wheel tiltingly attached to the respective cooperating end of the axle. While excavating, in particular when working on soft or delicate gound like lawn, or when extreme tearing or breaking forces are asked for, or for example when, while excavating a deep ditch, a 360-degree-turnability of the superstructure is needed despite a particularly low turning point of the excavator arm and tall wheels, it is therefore possible to tilt the wheels, preferably all the wheels present, from their vertical normal position so that the outer sides of the wheels come into contact with the ground. This measure automatically reduces the height of the excavator from the beginning, i. e. the chassis of the excavator is lower and therefore also its center of gravity so that the excavator can be prevented from tipping over on sloping ground. By tilting the wheels preferably sideways, the turning point of the excavator can also be lowered so that, in the same conditions, deeper holes or ditches can be excavated with the excavator arm still able to effect a 360-degree-turn. With the wheels tilted, an additional increasing ground adhesion comes into effect; however, with the same weight of the excavator the bearing pressure, i. e. the ground pressure per unit area is reduced. Furthermore, the tearing and breaking force of the excavator is increased by improving its ground adhesion. It is a further convenience of the invention that the excavator can be moved fast enough from one site to the other as a sufficient size of the wheels can be chosen thus facilitating the transportability of the excavator. The little space needed by the excavator is another important advantage as for example when working in tunnels or under bridges. If, despite the tilted wheels, the ground adhesion is not sufficient for extreme tearing tasks, it is possible to use additional supports and/or a scraper blade. Compared with the previously known excavators, the excavator of the present invention leaves by far fewer traces on the ground as it can have taller and therefore narrower wheels.

As part of a convenient further development of the invention, the wheel suspension is connected with a respective movable axle extension which is secured in a pulled-in position near the axle when the excavator moves or respectively is transported, and in a pulled-out or pushed-out position away from the axle when excavating tasks are done. With the axle extension moved out, the wheel fixed thereto is tilted outwards from its vertical normal or respectively driving position and its outer side comes into contact with the ground.

In accordance with another convenient development of the invention, the axles are in the form of hollow tubes, inside which the axle extensions can be moved and from which the latter protrude at either side. In order to actuate or respectively move the axle extensions, a cylinder, preferably a hydraulic cylinder, is used. The said cylinder can also be accommodated inside the hollow axle and is so protected from pollution and damage. When the excavator works on sloping ground or for example in ditches with sloping walls, there is no need for tilting the wheels sideways at a full 90-degree angle. It proves convenient to lead a striker bar against a roller fixed to the chassis in order to exactly and safely control the setting-up of the wheels.

The wheels of the excavator should have rubber tyres so that, without wasting time and damaging the roads, it can move from one site to the other as for example by a self-contained drive or drawn by another vehicle.

The following is a detailed account of one working example described with reference to the accompanying drawing.

Figure 4:
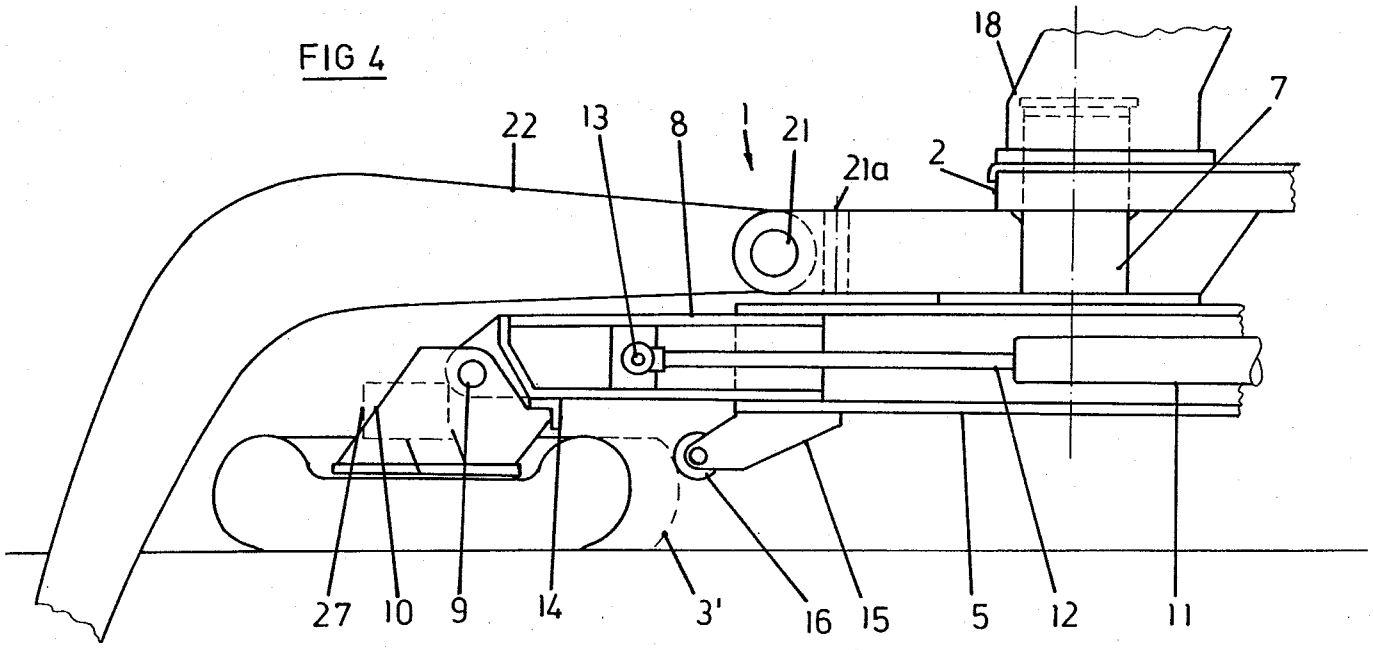
Figure 5:
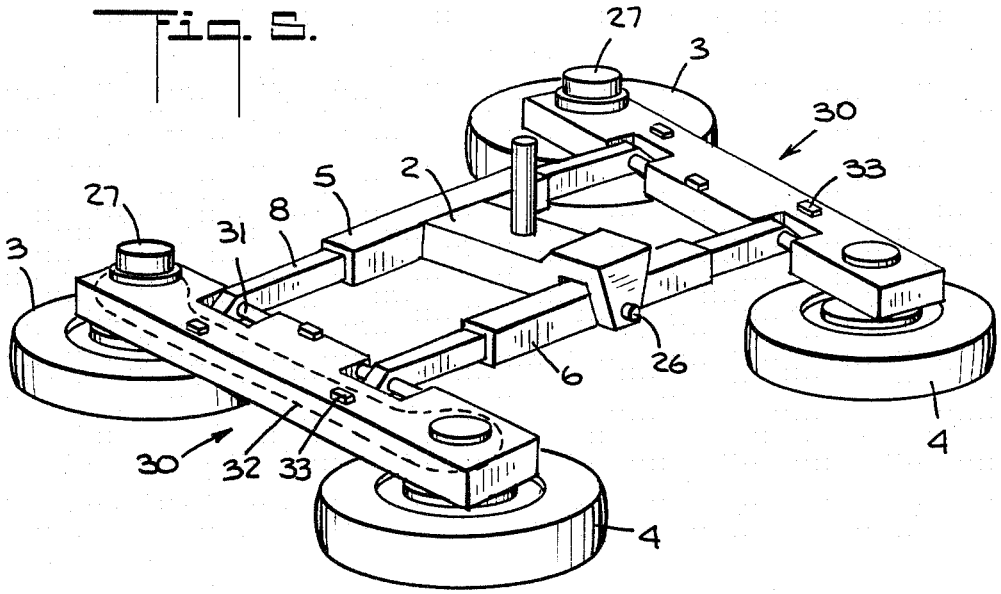
Figure 6:
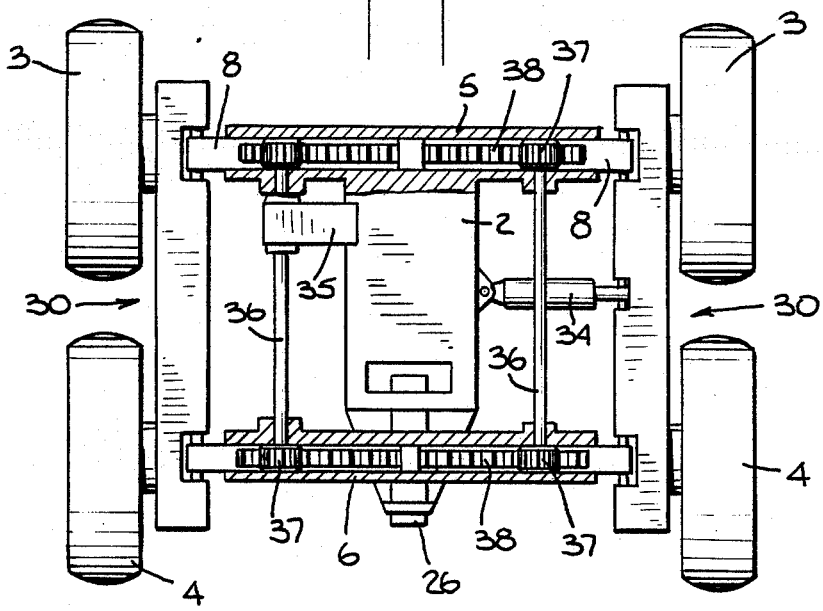

The figures in the drawing are:

FIG. 1: a chassis of the excavator of the invention with single-wheel suspensions in the driving position, FIG. 2: the chassis of FIG. 1 in the excavating position, FIG. 3: a partly sectional, schematic lateral view of the entire excavator with the wheels in the position of FIG. 1, FIG. 4: a partly sectional, schematic lateral view of the excavator with the wheels in the position of FIG. 2, FIG. 5: an excavator chassis as shown in FIG. 2 with track-parallel double-wheel suspensions, and FIG. 6: a schematic plan view from below of an excavator chassis with two track-paralle double-wheel suspensions in the driving position.

DETAILED ACCOUNT OF WORKING EXAMPLE OF THE INVENTION

The excavator shown in the FIGS. 1 to 6 preferably is a hydraulic, self-driving universal small excavator, which is specially suited for the kind of work mentioned at the beginning. However, the present invention is not restricted to such universal small excavators but can preferably also be used in all other kind of excavators known. FIG. 1 shows the under-carriage or respectively chassis 2 of the excavator described here in detail. The former contains a front and back pair of wheels 3 and respectively 4. The wheels 3 and respectively 4 are here accommodated singly on cooperating wedge-like wheel suspensions 10 and are located on either side of axles 5, 6 which are attached to the chassis 2 and are parallel to each other. Approximately in the middle of the chassis 2, there is indicated a turning pin or respectively column 7 for accommodating the super-structure or respectively the turret.

In the present invention, the wheels 3, 4 are not rigidly fixed to the respective axles as is usually the case but can be tilted. In the normal position shown in FIG. 1, all wheels 3, 4 can rotate as usual so that the excavator 1 can move. For excavating purposes, however, the wheels 3, 4 are tilted preferably to the side as can be seen in FIG. 2.

If the wheels are driven mechanically, the drive is uncoupled before or during the tilting procedure. However, as can be seen in the FIGS. 3 and 4, hydraulic motors 27 can preferably be used, which are accommodated on the wheels or respectively the wheel suspension 10, can be tilted with the wheels and maneuvered separately. If hydraulic motors supplied by flexible pipes are used, there is no more need for uncoupling when the tilting takes place. It is particularly convenient to use two hydraulic motors 27 located diagonally to each other so that a point turn can be achieved.

In order to make the wheels 3, 4 tilt to the side, they are attached to movable axle extensions 8. These axle extensions 8 are situated inside the hollow, preferably rectangular axles 5, 6 and project on either end of the axles 5, 6. On each of the axle extensions 8, there is, for example by means of a pin 9, a tiltable fastening device for one ot the wheels 3, 4, i.e. a wheel suspension 10.

The tilted position shown in FIG. 2 enables the excavator to work in particular on soft ground as the bearing surface has been considerably increased by the outer sides of the wheels 3, 4. it is obvious that the ground pressure per unit area is therefore essentially reduced whereby the center of gravity of the excavator and the turning points of the excavator arm are low achieving the advantages mentioned in the introduction of the description. In the working example described here, the individual extensions 8 can each, by means of a cylinder piston unit 11, 12, be moved from the pulled-in position shown in FIG. 1 to the pushed-out position of FIG. 2. For this purpose, it is convenient to use a hydraulic cylinder. As can be seen in FIG. 3, the said hydraulic cylinder is preferably also situated inside the cooperating axle 5 or respectively 6, and is so protected from pollution and damage. Securing the cylinder piston unit 11, 12 inside the axles 5 and respectively 6 and controlling it is done in the usual way. If a single, loosely arranged cylinder piston unit is used, both the piston rod 12 and the cylinder 11 are connected with a cooperating axle extension 8 by means of a pin 13 each. If a unit with two pistons opposite each other in one cylinder is used, the latter can be rigidly attached.

As indicated by a broken line in FIG. 4, the tilted tire 3' itself, in order to be raised, can first be pulled towards a tappet roller 16 and then be set up effecting a roll motion. As can be seen in the FIGS. 3 and 4, the raising motion of the wheels is defined on one side by stops in the form of striker bars 14 attached to the wheel suspensions 10. The said striker bars 14 can be so arranged as to butt against a tappet roller 16 when the wheels 3 or respectively 4 are raised. In order to improve the fixing or respectively stabilizing of the wheels, the latter in their raised position, can, via the wheel suspension 10, butt against another stop 28 fixed to the chassis. This stop 28 is situated above the tilting point of the wheel. The tappet roller 16 is located below it.

No stops are needed for tilting the wheels. Usually the ground adhesion of the wheels is sufficient. In order to tilt the wheels 3, 4 they are simply pushed outwards by the axle extensions 8. The tilting point of the wheels can be located below the middle of the wheels. The ground clearance of the tilting point of the wheels is the same as the distance of the outer surface of the wheels, which comes into contact with the ground, so that the ground clearance of the chassis 2 remains the same. There is practically no limitation as to increasing the size of the wheels. Still, with the wheels tilted, a 360-degree-rotation can be effected.

As can be seen in the FIGS. 3 and 4, a turning support 17 is attached to the turning pins 7 as for example via a gear ring not specified here. Above, there is indicated a control turret 18 with control and operating levers 19 which can be easily reached from the seat 20 of the excavator. Via a joint 21 there is also an excavator arm 22 attached to the turning support 17 or respectively to a plate located above it and not specified here. The excavator arm can be moved vertically by the joint 21 whereas the turning motion is effected round the pin 7. If, with the tilted position of the wheels 3, 4 for excavating purposes as shown in FIG. 2, there is the need for increased stability as for example in order to effect extreme pulling or breaking or respectively pushing tasks, it is possible to lower the scraper blade 24 which is fixed to a connecting rod 23 to the ground. If necessary further supports 25 can be brought down to the ground, which are tiltingly attached to the chassis 2 of the excavator 1. In FIG. 3, the scraper blade 24 and the supports 25 are staggered by 90° so giving a clear presentation.

As can be seen in the FIGS. 1 and 2, one axle, for example the axle 6, can be tilted about a pin 26 to suit uneven ground. If both axles can be turned, a locking mechanism, e. g. a pneumatic one, should be provided, which is also convenient for one turnable axle.

By means of an additional device, the excavator arm 22 can also be turned round the axle 21a parallel to the pin 7, which makes it possible to work exactly the walls of ditches to be excavated when the excavator is placed beside the ditch.

As can be seen from above, the principle of the present invention is not restricted to the working example of the FIGS. 1 to 4. There is the advantage of a variety of ways of using the invention as to fixing the wheels and controlling them for different functions, as well as of adopting the invention for the most various forms of excavators.

The basic design of the figurs 5 and 6 corresponds to the one of the FIGS. 1 to 4. Therefore the same reference numerals are used for the same parts. There is only one exception, i. e. the wheels 3, 4 are not accommodated singly on cooperating wheel suspensions. The wheels 3, 4 of each track are rather supported on a mutual double-wheel suspension 30 which itself is accommodated on the excavator chassis 2 such that it can be tilted sideways about an axis of tilt parallel to the center longitudinal axis of the excavator. In the working example shown here, the said chassis 2 also has two axles 5, 6 which run at right angles to the longitudinal direction and have on either end extendable and retractable axle extensions 8. By means of pins 31 aligned in the longitudinal direction of the vehicle, the axle extensions 8 which are located on the same side are connected hinge-like with a respective double-wheel suspension 30 bridging them. The double support of the double-wheel suspensions 30 and the bridging of the axles 5, 6 by means of the lateral double-wheel suspensions 30 running in the longitudinal direction results in a great stability. In order to achieve a good adaptation to the ground, one of the axles 5, 6 can be tilted about a pin 26 running in the longitudinal direction of the excavator as seen in the examples above. For avoiding pressure forces, in this case the pins 31 running in the longitudinal direction of the vehicle have an adequate degree of freedom.

The double-wheel suspensions 30 which here are located trackwise also make it possible to drivingly connect the wheels 3, 4 of each track which are situated behind each other. In the working example shown here, the front wheels 3 can each be driven by means of a driving motor in the form of a hydraulic motor 27 which is directly couped therewith. The back wheels 4 are drivingly connected with the respective adjacent front wheels 3 by means of a transmission gear 32 in the form of a chain drive. The result is an all-wheel drive with only one driving motor per track, which reduces the costs of construction. In order to accommodate the respective cooperating chain drive 32, the double-wheel suspensions 30, each of which accommodates a front wheel and the back wheel drivingly connected therewith, are in the from of hollow box girders. This makes it possible to protect the transmission gears 32. Appropriate inspection traps or the like guarantee accessibility. In the working example shown here, the driven shafts of the hydraulic motors 27 are directly connected with the respective cooperating front wheel 3 and have a chain wheel for driving the cooperating back wheel. Accordingly the hydraulic motors 27 are here coaxial with the respective cooperating front wheel 3. However, it would also be feasible to connect the two wheels of one track in the designated way by means of a transmission gear in the form of a chain drive, etc., and to introduce the driving torque into the transmission gear outwith a wheel axle if this is requested spacewise.

In view of effecting the tilting and raising motions of the double-wheel suspensions 30, practically the same holds true as for the single-wheel suspensions 10 of the FIGS. 1 to 4. The same also holds true for stabilising the double-wheel suspensions 30 safely in the driving position. For this purpose, the chassis 2 can be provided with stops not specified here of the kind indicated at 16 or respectively 28 in the FIGS. 3 and 4, which are staggered upwards or respectively downwards agaist the axis of tilt and against which come to rest the box-shaped double-wheel suspensions 30 with their inside. FIG. 5 shows a schematic representation of these contact dogs 33. As explained in connection with the FIGS. 1 to 4, the axle extensions 8 which act on the wheel suspensions 30 can be activated by single-drive mechanisms which are located at the axles 5 and respectively 6 and are in the form of respective cooperating cylinder piston units. However, the double-wheel suspensions 30, each of which connects two axle extensions 8, also make it possible to reduce the driving units, as shown schematically in FIG. 6.

The right half of FIG. 6 is an example of a cylinder piston unit which acts on the middle of the cooperating double-wheel suspension 30 and, on the other side, is supported on the chassis 2. The left half of FIG. 6 shows a rotational engine 35, which serves to move the axle extensions 8 in and out and for example is in the form of a hydraulic rotational piston engine. In order to synchronise the axle extensions 8 of both axles, 5, 6, which are activated in pairs and act on the same wheel suspension, there is a synchronising shaft 36 each, which bridges the distance between the axle extensions 8 activated in pairs, is bearinged on the side of the axles, and, by means of wedged-on cog wheels 37, engages with racks 38 put onto the cooperating axle extensions 7. The cog wheels 37 can be in cambered form in order to avoid pressure forces due to the axle 6 being tiltable about the pin 26. For accommodating the racks 38, the axle extensions 8 can have chamber-like recesses so that, despite the toothing asked for, a safe longitudinal guide of the axle extensions 8 in the respective axle 5, 6 is guaranteed. The racks 38 can be adjustable in order to compensate for a possible twisting of the synchronising shafts 36.

In the design of the right half of FIG. 6 with a pushing-out device in form of the cylinder piston unit 34 acting directly on the wheel suspension 30, the synchronising shaft 36 is simply so bearinged that it can turn freely. A design of this kind can also be used for individually driven axle extensions 8 as for example of the kind shown in the FIGS. 1 to 4 if a mechanical synchronisation is asked for. In the design of the left half of FIG. 6, the synchronising shaft 36 is directly driven by means of the rotational engine 35. In this case, the synchronising shaft 36 is drivingly connected with the engine 35 attached to the chassis 2, as for example put through the rotor and wedged thereon.

As can be seen in the examples above, the principle of the invention might not only be used for the working examples of the FIGS. 1 to 6. Therefore, the double-wheel suspensions 30 of the FIGS. 5 and 6 could also be accommodated on only one axle extension each which is secured against tilting so that, instead of the H-shaped chassis, there would be a cross-shaped one. In the design of the FIGS. 1 to 4, it would also be feasible to synchronise the axle extensions 8 in pairs and to move them by means of a mutual actuating device.

I claim:

1. An excavator, comprising:

an excavator arm;

a turning mechanism having a control device and a driving device;

at least one pair of wheels connected with, and supported on the ends of, an axle, with a track for each of said wheels, said axle having two axle extensions which cooperate with said tracks of said wheels;

an undercarriage attached to said excavator arm by means of said turning mechanism with said control device and said driving device, as well as with at least one of said pairs of wheels, wherein each of said wheels is connected with at least one of said axles so that each of said wheels is capable of being tilted sideways about an axis of tilt parallel to the longitudinal axis of said excavator, said axle being capable of being stabilized in a raised position, and on said undercarriage of said excavator, there is at least one of said axles with two of said axle extensions, which cooperate with two of said tracks, said axle extensions being capable of being moved inwardly and outwardly and held in a pulled-in position near said axle, when said excavator moves or is transported, and in a pulled-out or pushed-out position away from said axle for excavating purposes, with each of said axle extensions being moved out and with each of said wheels supported thereon being tilted outwardly from its vertical normal position so that an outer side of at least one of said wheel comes into contact with the ground.

2. An excavator as claimed in claim 1 wherein each of said axle extensions of each of two of said axles accommodates one cooperating wheel each of which is capable of being tilted individually.

3. An excavator as claimed in claim 2 wherein a wedge-shaped single-wheel suspension, which accommodates a wheel each is capable of being tilted outwardly at approximately a 90-degree angle, is attached to outer ends of each of said axle extensions by means of a pin each, which runs in a longitudinal direction of the excavator.

4. An excavator as claimed in claim 1 wherein at least two of said wheels are operated in combination with a driving mechanism.

5. An excavator as claimed in claim 4 wherein two of said wheels are operated in combination with said driving mechanism with said two wheels being diagonally positioned to one another.

6. An excavator as claimed in claim 4 wherein at least two wheels have two of said driving mechanisms placed in cooperation with a wheel suspension.

7. An excavator as claimed in claim 6 wherein the driving mechanisms are in the form of hydraulic motors.

8. An excavator as claimed in claim 1 wherein the middle part of each axle is a rectangular hollow pipe accommodating inside on either end the axle extensions, which have a corresponding rectangular cross-section and can be moved.

9. An excavator as claimed in claim 1 wherein said axle extensions, which are located opposite each other, are capable of being moved by at least one cylinder piston unit, which is situated inside a cooperating axle.

10. An excavator as claimed in claim 1 wherein the raising motion of said wheels is defined by at least one stop on a wheel suspension, each of which butts against a counter stop on said undercarriage or one of said axles.

11. An excavator as claimed in claim 1 wherein said undercarriage accommodates at least one of said axles which is capable of being tilted about a pin running in a longitudinal direction of said excavator.

12. An excavator as claimed in claim 11 wherein at least one of said tiltable axles has an hydraulic locking mechanism.

13. An excavator as claimed in claim 1 wherein said wheels have rubber tires.

14. An excavator as claimed in claim 1 wherein the axis of tilt of said wheels is lower than the center of said wheels and has a ground clearance which approximately corresponds to the distance between an outer side of said wheels resting on the ground, when the latter are tilted, and the axis of tilt so that said undercarriage is of approximately the same horizontal height whether the wheels are tilted or not.

15. An excavator as claimed in claim 1 wherein the axis of tilt a wheel suspension is lower than the center of said wheels and has a ground clearance which approximately corresponds to the distance between an outer side of said wheels resting on the ground, when the latter are tilted, and the axis of tilt so that said undercarriage is of approximately the same horizontal height whether the wheels are tilted or not.

16. An excavator as claimed in claim 1 wherein said excavator arm has a first joint and a superstructure carrying said excavator arm has a second joint, said first joint and said second joint are located just above said axles and below a lower edge of said wheels when said wheels are in a raised position.

* * * * *